US005346312A

United States Patent [19]

Mabry et al.

[11] Patent Number: 5,346,312

[45] Date of Patent: Sep. 13, 1994

[54] BAGS FOR MAINTAINING CRISPNESS OF COOKED FOODSTUFF

[75] Inventors: Ronald D. Mabry, Orchard Park, N.Y.; Gerald F. Unger, Richmond Hts., Ohio

[73] Assignees: Flexo Transparent Inc., Buffalo, N.Y.; The Unger Company, Cleveland, Ohio

[21] Appl. No.: 72,885

[22] Filed: Jun. 7, 1993

[51] Int. Cl.[5] ..... B65D 30/08

[52] U.S. Cl. ..... 383/113; 383/101; 383/105; 206/204; 426/124; 426/118

[58] Field of Search ..... 383/100, 101, 102, 105, 383/109, 113, 127; 206/204; 426/118, 124

[56] References Cited

U.S. PATENT DOCUMENTS

| | | | |
|---|---|---|---|
| 3,628,720 | 12/1971 | Schmedding | 383/101 |
| 4,252,516 | 2/1981 | Raley et al. . | |
| 4,275,811 | 6/1981 | Miller . | |
| 4,317,792 | 3/1982 | Raley et al. . | |
| 4,321,997 | 3/1982 | Miller . | |
| 4,328,895 | 5/1982 | Jaeger | 383/109 X |
| 4,456,570 | 6/1984 | Thomas et al. . | |
| 4,518,643 | 5/1985 | Francis . | |
| 4,535,020 | 8/1985 | Thomas et al. . | |
| 4,550,546 | 11/1985 | Raley et al. . | |
| 4,622,036 | 11/1986 | Goodrum . | |
| 4,644,623 | 2/1987 | Raley et al. . | |
| 4,657,133 | 4/1987 | Komatsu et al. | 426/124 X |
| 4,734,292 | 3/1988 | Gerardus Van Boxtel | 426/124 X |
| 4,743,123 | 5/1988 | Legters et al. . | |
| 4,797,010 | 1/1989 | Coelho . | |
| 4,861,632 | 8/1989 | Caggiano | 383/109 X |
| 4,866,786 | 9/1989 | Nagler | 383/101 |
| 4,984,907 | 1/1991 | Power | 383/117 X |
| 5,132,151 | 7/1992 | Graney . | |
| 5,135,787 | 8/1992 | Bair . | |

FOREIGN PATENT DOCUMENTS

| | | | |
|---|---|---|---|
| 4128166 | 4/1992 | Japan | 426/124 |

OTHER PUBLICATIONS

Vispore Film Promises Convenience, Tredegar Film Products 1990.

*Primary Examiner*—Allan N. Shoap
*Assistant Examiner*—Jes F. Pascua
*Attorney, Agent, or Firm*—Howard M. Ellis

[57] ABSTRACT

Packaging in the form of disposable, low cost bags for cooked foods, such as chicken, fish, seafoods and hot baked specialties like pizza maintain the food in a hot crisp and appetizing condition until consumed with little or no sogginess occurring due to being in contact with water vapor/steam, condensate or residual cooking oils/fats. The bags have a nonlaminated multi-ply film composite consisting of at least a nonporous outer ply and an inner porous ply as a liner. The plies are spaced so as to provide a gap in the form of enclosed fluid reservoir for collecting and separating fluids from the food for maintaining crispness with little back flow of condensate and oils to the food compartment. Special materials and pads for absorption and retention of such fluids may be eliminated.

29 Claims, 3 Drawing Sheets

BAGS FOR MAINTAINING CRISPNESS OF COOKED FOODSTUFF

TECHNICAL FIELD

The present invention relates generally to packaging materials for foodstuff, and more specifically, to highly economical disposable bags for packaging and maintaining cooked foods in a crisp, hot condition without becoming soggy before consumed.

BACKGROUND OF THE INVENTION

Hot cooked foods, such as fried chicken, deep fried fish and seafood, french fried potatoes, pizza and other so called "fast foods" are hot and usually greasy from residual cooking oil. When packaged in conventional containers at the time of sale steam from the hot food cools and condenses, and residual oil and grease draining from the food form pools of moisture (condensate/-water) and oil, which makes contact with the food. Consequently, the hot and originally crispy appetizing food often becomes soggy before it is consumed, and less palatable to the buyer. Consumer complaints and lost business can result.

In an effort to overcome the problems associated with packaging hot oily/greasy foods various containers have been developed. While some have been useful in remedying problems of venting steam from hot foods they have not been entirely satisfactory in eliminating sogginess with highly economic disposable packaging. For example, U.S. Pat. 4,797,010 discloses a dual walled insulating bag for packaging fried foods. To prevent sogginess from occurring an inner liner is utilized for absorbing oil/grease from the packaged foodstuff. However, because the liner retains the absorbed grease instead of carrying it away from the foodstuff, portions of the packaged foodstuff remain in contact with the grease/oil soaked liner. Reabsorption of grease/oil by the food can occur through a wicking effect.

U.S. Pat. No. 4,984,907 discloses another type of grease absorbent packaging wherein a porous nonabsorbent liner grid or netting allows for the transmission of grease, fat and oil from the food into an absorbent material positioned between the grid and outer wall of the packaging. Packaging fabricated with inner absorbent materials are often costly to manufacture, and are non-economic as single use, disposable type bags. U.S. Pat. No. 5,135,787 discloses a further representative example of a food packaging system which relies on an intermediate positioned pad for absorption of liquid during shipping. In order to accommodate the absorbent pad the inner porous bottom wall is elevated from the floor of the package resulting in a substantial trade off in storage capacity. In addition, when the bottom wall of the package is resting on a surface liquid collecting in the bottom compartment may be transferred back to the food compartment. A further representative receptacle which relies on absorbent materials for packaging fluid exuding food products is disclosed by U.S. Pat. No. 4,321,997.

U.S. Pat. No. 3,628,720 discloses a further embodiment of a bag having dual ply walls. However, both the inner liner ply and the outer bag ply have perforations. Such a design would not be suitable for use as a leak proof bag for collecting residual cooking oil and condensate from fried foods. U.S. Pat. No. 4,743,123 also discloses a dual walled bag with offset perforations in both the inner and outer plies. They are employed in packaging powdered products, such as lime, PVC, cocoa, gypsum and cement. The perforated dual plies avoid residual air pockets developing during the filling process.

U.S. Pat. No. 5,132,151 discloses a microwavable packaging system with a multi-ply composite cover having an inner first ply with a plurality of tapered openings in the form of protuberances extending outwardly towards a removable nonporous outer ply. Upon removal of the outer ply, fluids, gases and aromas from the interior of the package are able to escape through the openings in the first ply. Pressure build-up from steam in the container is avoided during the cooking process when the nonporous outer ply is removed. According to U.S. Pat. No. 5,132,151, prior to removal the tapered openings of the porous ply are required to be closed with the nonporous outer ply of film. The intact multi-ply laminated composite would not be suitable for sidewalls of a food container since the blocked openings would prevent transmission of fluids from the interior of the package.

Accordingly, there is a need for more economic packaging for foodstuff, and in particular low cost bags for maintaining cooked foods in a hot, crisp condition after sale, and which avoid sogginess from occurring as a result of the packaged food being in contact with condensing steam and residual oil from the cooking process. Such bags should be leak-proof to liquids and also be capable of mechanically separating steam and oil from the food before it condenses or becomes reabsorbed as it collects on side and bottom walls in the food compartment, all without requiring special absorbent materials, pads, and the like.

SUMMARY OF THE INVENTION

Accordingly, it is a principal object of the invention to provide for novel, highly economic packaging for cooked foods which maintains the foods in a hot, crisp condition until consumed with little or no sogginess occurring due to contact with water vapor, condensate from steam or residual cooking oils/fats. While such packaging can be effectively employed in maintaining the freshness of uncooked foods, such as fresh meats, seafoods and fresh vegetables where liquids, blood, juices, etc., have a tendency to drain from the foodstuff after being packaged, the primary object of the invention is to provide improved packaging for hot cooked foods, especially foods customarily fried in cooking oil/fat, such as chicken, fish, seafood, such as fried shrimp and clams; fried potatoes, onions, hush puppies, corn dogs, egg rolls and other so called "convenience", "fast foods" or "prepared foods." This utility is also intended to include packaging for nonfried, but otherwise hot carry-out foods, such as pizza, calzones and other hot baked specialties where the desired crispness of the crust, shell or bread portion can be lost mainly as a result of steam and condensation. Other hot food applications include steamed foods, such as shrimp and clams, and whenever it is desirable to separate condensation, etc., from a foodstuff to avoid sogginess.

The above objects are achieved principally through flexible multi-ply bags, i.e. bags having at least two film plies. The bags have a food compartment defined by multi-ply walls, i.e. walls comprising at least:

(a) a nonporous exterior film ply, and (b) a porous interior film ply having inner and outer surfaces. The outer surface of the porous interior film ply is in proximity to the nonporous exterior film ply. The porous interior film ply and nonporous exterior film ply are spaced sufficiently away from one another to form an enclosed fluid reservoir or pocket for retaining condensation, oil/fat, and the like. In a preferred embodiment, the porous interior film ply is characterized by a plurality of tapered apertures extending from the outer surface into the fluid reservoir for transmission of steam and residual cooking oil/fat from the food compartment.

It is yet a further principal object of the invention to provide for crispness bags for hot cooked foods in which the bag walls have at least (a) a nonporous exterior film ply, and (b) a porous nonabsorbent bag liner ply having an inner surface for engaging with cooked foods in an inner food compartment or receptacle, and an outer surface spaced from the nonporous exterior film ply to form an enclosed vacant air space functioning as a fluid reservoir between the nonporous exterior film ply and porous nonabsorbent bag liner ply. The porous nonabsorbent bag liner ply has a plurality of regularly spaced apertures communicating with the food compartment and fluid reservoir. The apertures are of a configuration which readily allows transmission of steam/vapors, aqueous and oily liquids from the food compartment to the fluid reservoir while minimizing the back flow of such liquids, including condensate from the fluid reservoir to the food compartment.

It is yet a further object of the invention to provide for bags for maintaining the crispness of hot foods cooked in oil, like fried chicken, or oven baked foods, such as pizza, calzones and other bread containing specialties where crispness of the foodstuff contributes to customer acceptance. The crispness bags have flexible walls conformed into the shape of a food compartment, e.g. size and configuration for holding pizza slices or an entire pie. The walls are in the form of a nonlaminated multi-ply film composite having at least:

(a) a nonporous exterior film ply, and (b) a porous nonabsorbent bag liner ply having an inner surface for engaging with cooked foods in the food compartment and an outer surface spaced from the nonporous exterior film ply to form an enclosed vacant fluid reservoir between the nonporous exterior film ply and porous nonabsorbent bag liner ply. The porous nonabsorbent bag liner ply has a plurality of apertures which readily permit the transmission of hot oil/fat and steam from the food to the fluid reservoir while restricting back flow from the reservoir to the food compartment of condensate and collected oil, which has cooled and has become more viscous.

Thus, in accordance with the invention improved food bags are provided having nonlaminated, nonabsorbent, multi-ply composite walls with a reservoir for receiving and retaining fluids, e.g. steam, oils/fats from the food compartment. The reservoir is positioned in the interior of the non-laminated composite between an outer nonporous exterior film ply and inner porous liner ply. Apertures in the porous interior liner ply preferably have protuberances narrowing in the direction of the nonporous exterior film ply to readily collect the steam, fats and oils from the food compartment for transmission into the fluid reservoir. Steam, upon entry into the enclosed fluid reservoir which is an empty air space, condenses to a liquid on contact with the cooler exterior nonporous wall of the bag. In a similar manner hot cooking oil and fats cool. Because of the generally small size of the apertures little, if any, of the collected cooled oil and condensate is able to readily re-enter the apertures and pass back into the food compartment to make contact with the packaged foodstuff and cause sogginess.

Preferably, the protuberances in the porous interior film ply liner have a conical configuration. This added feature mechanically restricts back flow of condensate and cooled cooking oil from the fluid reservoir compartment to the food compartment. Hence, in accordance with the present invention fluids, e.g. steam, moisture, oil, etc., from packaged hot foods are efficiently separated and remain segregated in a separate compartment away from the foodstuff before it collects, saturates the food and causes a loss of crispness.

Advantageously, the packaging of the present invention neither requires, nor needs special liners or inserts for absorbing liquids. Such liners only add to the cost of the packaging in terms of manufacturing and material costs. The nonlaminated, multi-ply composite walls and reservoir in the form of an enclosed air space between the film plies limit heat loss from the food across the walls. Accordingly, the multi-ply bags possess the added feature of excellent insulative properties.

It is yet a further object of the invention to provide various styles of bag construction for packaging food products as disclosed herein, including sandwich style bags having dual opposing side walls sealed to one another along peripheral edges. Such bags may have an expandable bottom wall. Similarly, bags of the invention may have expandable side walls. The invention also contemplates bags having opposing quadrilateral side walls and a bottom wall comparable in shape to foldable kraft style paper bags.

It is still a further important object of the invention to provide for nonlaminated multi-ply composite film as flat stock for manufacturing packaging as described herein. The nonlaminated composite consists of a first nonporous film ply and a second porous film ply having regularly spaced apertures which are preferably tapered and extend toward the nonporous film ply. The flat stock is preferably prepared as dual ply rolled film.

DESCRIPTION OF THE PREFERRED EMBODIMENTS

Figure 1:
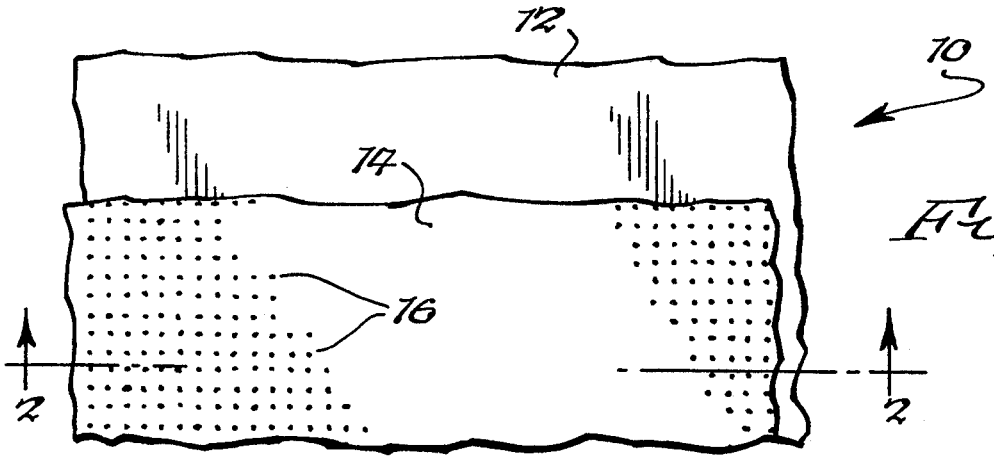
FIG. 1 is a top fragmented view of the nonlaminated multi-ply film composite with a portion of the porous top film ply broken away to provide a view of the nonporous bottom film ply.

Turning first to FIG. 1, there is shown a fragmented view of nonlaminated film composite 10, consisting of a first film ply 12 and a second film ply 14. While only two plies are specifically illustrated the present invention is intended to include film composites having two or more film plies, e.g. 3 or 4 plies, provided the combination of first and second film plies as discussed herein are employed as a primary composite structure of the packaging.

First ply 12 is in the form of a continuous, nonporous flexible film having a thickness generally in the range from about 0.30 to about 5.0 mils, and more specifically, from about 0.5 to about 2.0 mils. The thicker, heavier grade films offer greater insulative properties against heat loss than the thinner grade materials. Compositionally, the nonporous first film ply 12 may be any approved food grade thermoplastic material, particularly the polyolefins, like polyethylene, both high and low density types, polypropylene, blends of high and low density polyethylenes, and so on. Other suitable films include PVC, polystyrene and the polyesters, such as PET. The polyolefins overall are generally preferred in terms of performance, economics and availability. High density materials, like high density polyethylene (HDPE) along with blends of high and low density polymers are preferred over low density polyethylene because of their ability to withstand the higher temperature ranges associated with packaging hot foods. Polyesters, such as PET, nylons, etc., while more costly can also be employed as materials in fabricating the walls of the packaging disclosed herein.

Second ply 14 also consists of a flexible film, but with a plurality of small pores or perforations 16 penetrating the film. Perforations 16 are in close proximity to one another and regularly spaced as opposed to being randomly positioned.

First and second film plies 12 and 14 with the exception of strategically placed heat seals (not shown by FIG.1) employed in fabricating the packaging and described in greater detail below, are not united into superimposed, integral one-piece laminated film structures. Instead, plies 12 and 14 remain spaced from each other into a nonlaminated composite structure, best illustrated by FIGS. 2 and 3.

Figure 2:
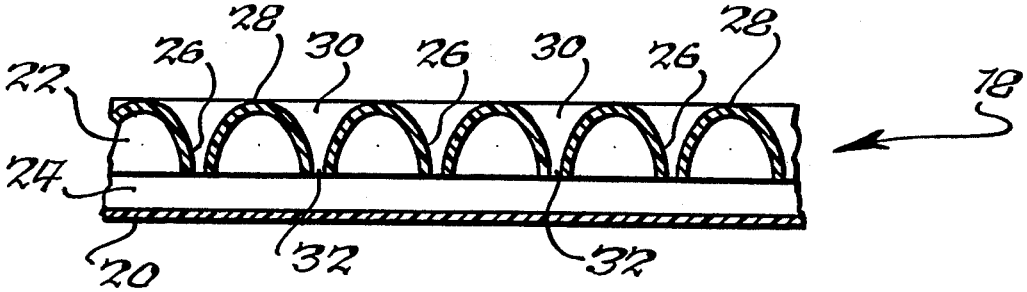
FIG. 2 is an enlarged sectional view of the nonlaminated multi-ply film composite taken along line 2—2 of FIG. 1 showing one embodiment of the apertures.
Figure 3:
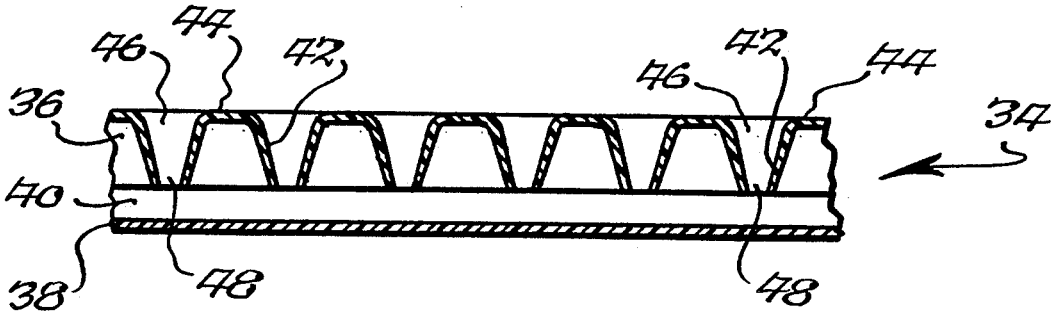
FIG. 3 is an enlarged sectional view of the nonlaminated multi-ply film composite showing a further embodiment of the apertures.

In this regard, FIGS. 2 and 3 illustrate but two possible magnified embodiments of the nonlaminated multiply composites, showing the positioning of the dual film plies relative to one another and the representative micro-structural characteristics of the porous film plies. It should be understood, however, that the structural characteristics of the porous film plies illustrated herein are only representative, and that in practice many variations and modifications of the porous structures can exist between grades of film, and among film manufacturers. Accordingly, this disclosure and the appended claims are intended to include all such variations and modifications.

FIG. 2 shows composite 18 in which nonporous film ply 20 and porous film ply 22 are separated from each other by a narrow gap 24. While gap 24 is illustrated having a uniform dimension by evenly spacing of plies 20 and 22 relative to each other, in practice the breadth of the gap is usually not fully uniform since the plies of film have a relaxed posture and do not require the use of spacers or other equivalent elements.

Porous film ply 22 is shown with regularly spaced hollow protuberances 26 extending downwardly from upper surface 28 and into gap 24. Protuberances 26 are generally conically shaped with wide fluid inlets 30 at upper surface 28 of the film which gradually narrow to fluid outlets 32 in the direction of nonporous film ply 20. The two plies are spaced sufficiently from each other in forming gap 24 to allow fluids, i.e. water vapor/steam and oily liquids to readily enter the empty space defined by loosely arranging the plies. In other words, the film plies are not flush mounted with one another so as to form a barrier to the free-flow of fluids from outlets 32 of the pores.

FIG. 3 illustrates a further embodiment 34 of a nonlaminated film composite having an upper porous film ply 36, a lower nonporous film ply 38 and a gap 40 therebetween. FIG. 3 illustrates magnified protuberances 42 extending downwardly from upper surface 44 of film ply 36. Fluid inlets 46 at the film surface are of such breadth as to promote the collection of steam and oil (not shown) for transmission downwardly in the direction of the narrowing fluid outlets 48 of the generally funnel shaped protuberances which discharges them into the space created by gap 40 between the two plies. The upper surface 44 of the porous film ply has a relatively smooth even surface. Whereas, the underside of the porous film ply due to the elevations created by the protuberances has a rougher hand.

As previously mentioned, as a result of the tapered configuration of the pores fluids, including steam and oil/fat more readily flow in the direction from the porous film ply towards the gap and non-porous film ply. Similarly, because of the narrower breadth of the fluid outlets little or no back flow of water vapor, condensate, oil, etc., occurs, thereby overcoming the primary cause of sogginess of packaged hot food.

The perforated films employed in the nonlaminated film composites of this invention are well known and fully described in the literature. For example, U.S. Pat. Nos. 4,317,792; 4,456,570 and 4,535,020 disclose the porous films and methods for their manufacture, the contents of all of such patents are incorporated-by-reference herein. The porous film having tapered apertures are also commercially available through ordinary channels of commerce under the registered trademark, VisPore, from Tredegar Film Products, Richmond, Va. Representative preferred grades of VisPore films for use in fabricating the packaging disclosed herein generally include those characterized by a film open area from about 12 to about 20 percent, a mesh size in a range from about 18 to about 24 apertures/lineal inch, and an embossed film thickness ranging from about 20 to about 25 mils. More specifically, preferred grades of porous film include those having an open area from about 14 to about 18 percent, a mesh size in a range from about 20 to about 22 apertures/lineal inch, an embossed film thickness from about 21 to about 24 mils, and a film composition consisting of a blend of polyolefins, such as high density polyethylene and low density polyethylene. The open area or openness of the film reflects the amount of film removed in forming the perforations.

Measurement of the thickness of the embossed films employed as the interior liner of bags according to the invention is preferably determined with a low-load type micrometer, such as a motorized low-load micrometer available from Testing Machines, Inc., Model 49-70 (2 inch diameter anvil, loading to be 95 g/in$^2$). Such a device initially should be calibrated by first turning on the micrometer switch allowing it to make at least three cycles before measuring thickness. A piece of clean paper is placed between the raised anvil and pulled out while the anvils are closed to remove any foreign material present between the anvils. The instrument should be adjusted so the digital display reads 0.00. In testing, one specimen per sample is tested. The specimen should be about 4 inches long and include the entire flat width of the sample. Samples should be clean and free of wrinkles and creases. The sample is inserted under the raised anvil and the anvil is allowed to come to a complete rest on the sample. A reading is taken from the digital display and recorded. A representative number of readings is taken on each sample to the nearest 0.1 mil. That is "embossed thickness" for this invention is intended to mean average thickness. Average thickness is determined by dividing the sum of thicknesses of the readings by the number of readings. Readings should be taken about every 6 inches across the flat width for wide films and every 3 inches for narrow width flat films. Debris in the sample may stick to the anvils causing false readings. For this reason, the digital display should be checked for a zero reading after testing, and if the unit is not at zero after testing those results should be disregarded, and the film retested. It is important not to read the same point twice on the sample since the pressure of the anvil will cause changes in film thickness.

Some preferred representative grades of film for use as the porous film ply in packaging hot fried foods, such as chicken include VisPore® 6606 and 6605. Others useful grades include VisPore 6150 and 6178. It was discovered that in packaging hot fried foods, that films having apertures which were either too large, e.g. from 8 to 12 holes/lineal inch, or too small, e.g. 30 to 40 holes/lineal inch, that performance of the packaging in maintaining crispness and avoiding sogginess was less satisfactory. While selection of optimum porous film plies is frequently carried out on a trial and error basis, there is believed to be some correlation between the volume of steam given off by a cooked foodstuff and the film pore size required in achieving optimum performance in avoiding sogginess. For example, in most instances chicken has a higher water content than pizza and more steam is generated by chicken after the cooking cycle has been completed. As a result, it has been observed that the size of the apertures of the porous film ply used in packaging chicken generally should be larger than for packaging pizza. However, this observation may vary depending on the temperature of the food at the time of packaging. For example, chicken stored in a warmer @ 125° F. can give off less moisture than pizza coming out of the baking oven at 450° F. due to the chicken having reached equilibrium with the temperature of the warmer. Under such circumstances, the hot pizza coming from the oven may require packaging with larger pores sizes as a result of the higher temperature of the foodstuff at the time of sale.

Figure 4:
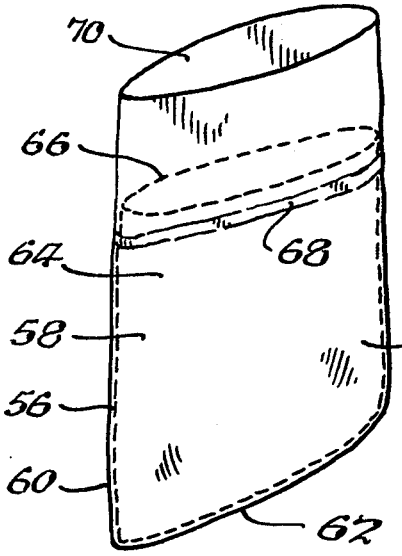
FIG. 4 is an isometric view of one bag construction of the invention having dual opposing side walls.
Figure 5:
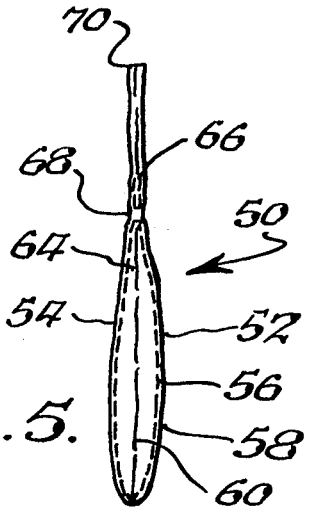
FIG. 5 is an end elevational view of the bag of FIG. 4.

The nonlaminated film composite of FIGS. 1–3 can be fabricated into a variety of bag configurations such as those of FIGS. 4–8. FIGS. 4 and 5 illustrate a bag 50 having dual side wall panels 52 and 54 formed from the multi-ply nonlaminated film composites as discussed hereinabove. FIGS. 4 and 5 show in broken lines interior porous film ply 56 as the bag liner and nonporous exterior film ply 58 as the outer wall of the bag. Side wall panels 52 and 54 are sealed together along outer edge 60 by conventional known means, e.g. heat sealing, after folding in half along bottom edge 62 which forms the base of receptacle 64. The bag liner ply 56 extends upwardly and forms a continuous interior liner for receptacle 64 and terminates at the mouth 66 of the receptacle. The inlet portion of the bag which does not hold foodstuff need not have a porous interior film ply. The inner liner 56 and the outer bag wall 58 are sealed together with heat at the mouth 66 of the receptacle portion of the bag, forming a continuous seal 68. The bag may be closed by any of the commonly known means, e.g. folding the terminal portion 70 of the nonporous exterior film ply, twist tie, zipper-type closures, etc.

Figure 6:
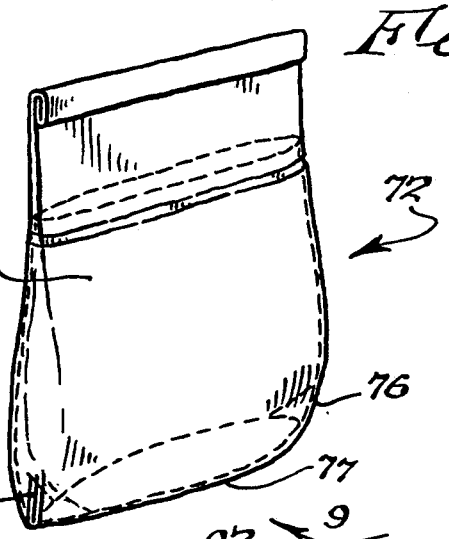
FIG. 6 is an isometric view of a further bag construction wherein the bottom wall is gussetted for expansion.
Figure 7:
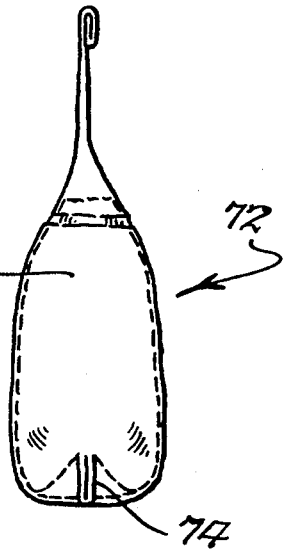
FIG. 7 is an end elevational view of the bag of FIG. 6.

FIGS. 6 and 7 illustrate a dual side wall bag similar to that of FIGS. 4 and 5, except bag 72 includes gussets 74 and 76 at the bottom edges of the side walls allowing for a folded out-expanded bottom wall 77 for greater capacity of receptacle 78.

Figure 8:
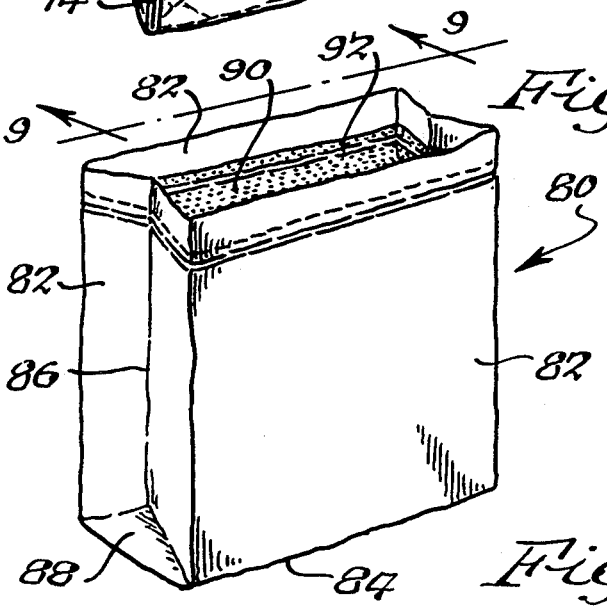
FIG. 8 is a representative example of a further bag having quadrilateral side walls which are expandable.
Figure 10:
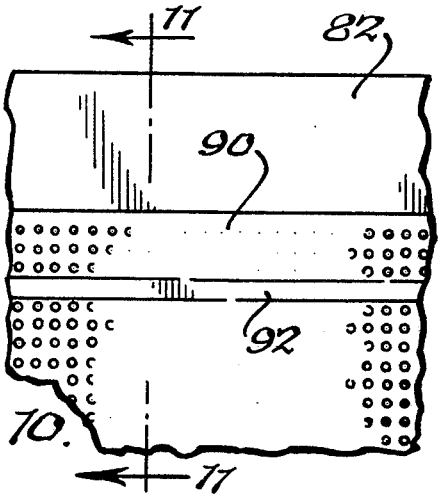
FIG. 10 is a fragmented interior view of a bag showing the porous liner with enlarged apertures.
Figure 9:
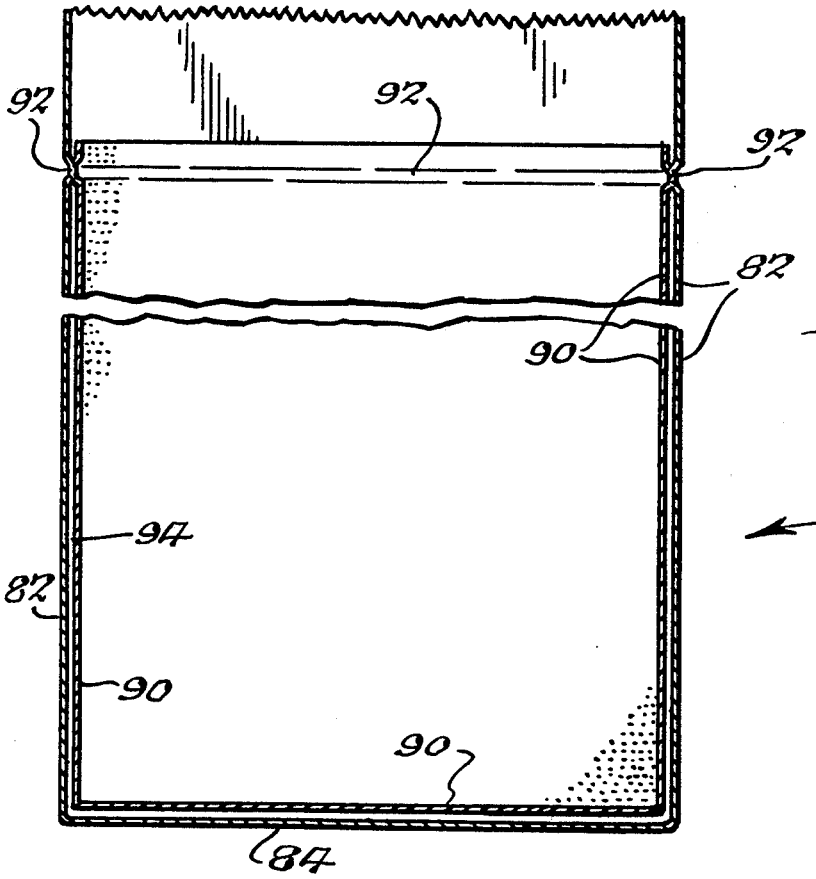
FIG. 9 is an elevated sectional view showing the inner side wall construction of the bag taken along line 9—9 of FIG. 8.

A further representative embodiment of packaging according to the invention is illustrated by FIGS. 8, 9 and 10, in the form of a kraft style bag 80 consisting of four side walls 82 and a bottom wall 84. Side walls can be made to expand by including a centrally positioned vertical fold 86 and a gusset 88 (FIG. 8) at the base of each vertical fold. Bag 80 is also equipped with a porous liner 90. The upper edge of the liner is recessed inwardly below the lip of the bag opening and heat sealed at 92 to the non-porous outer wall 82. FIG. 9 best illustrates air space 94 in the form of a gap between inner porous liner 90 and the non-porous outer side walls 82 and bottom wall 84. Air space 94 becomes an enclosed fluid reservoir for collected steam, water vapor, residual cooking oil, etc., by application of seal 92 at the upper tier of the bag thereby retaining all such fluids without spilling or leakage occurring. The inner porous liner 90 is preferably a nonabsorbent polymeric film, and therefore, all fluids including water vapor and residual fats/oils from the packaged food are transported away for the food and into the fluid reservoir where it is retained.

Figure 11:
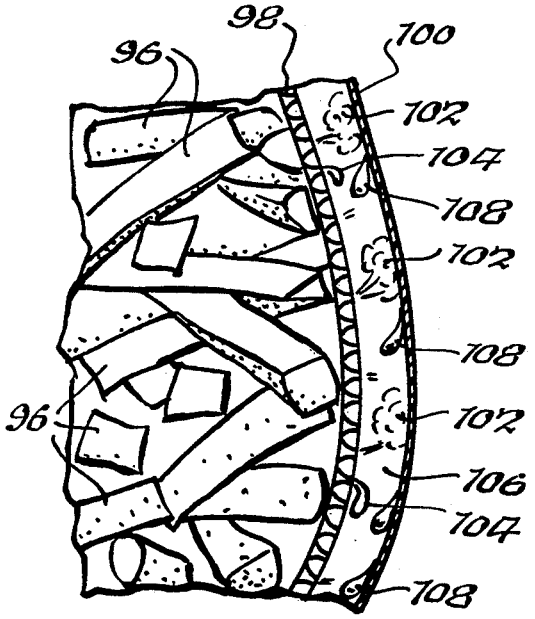
FIG. 11 is an enlarged fragmented sectional view of a bag filled with fried potato sticks taken along line 11—11 of FIG. 10.
Figure 12:
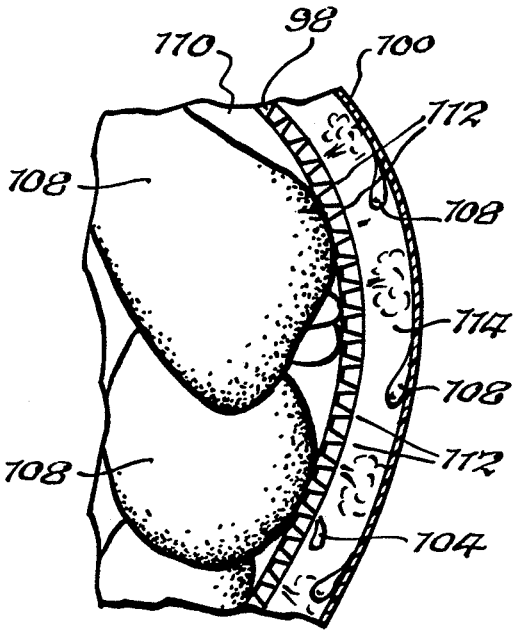
FIG. 12 is an enlarged fragmented view of an alternative non-laminated film composite bag filled with fried chicken.

FIGS. 11 and 12 demonstrate operation of bags of the invention in maintaining crispness of packaged hot fried foods by separating away fluids from the food into an enclosed reservoir, substantially eliminating sogginess. FIG. 11 illustrates hot french fried potatoes 96 retained by porous liner film ply 98, magnified. The outer bag wall consisting of nonporous film ply 100 is spaced from liner film ply 98 allowing steam 102 and residual cooking oil 104 to readily enter reservoir 106. Steam 102 in contacting the cooler outer bag wall 100 condenses. Condensate 108 forms on the cooler outer wall and may collect in pools with oil in the lower regions of reservoir 106.

Similarly, hot fried chicken 108 discharges steam/water vapor into food receptacle 110 of the bag for transmission through pores 112 in the inner bag liner and into reservoir/air space 114 where it condenses and is retained with oil in collected pools with little or virtually no back flow into the food receptacle occurring. The hot food remains fresh and crisp.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

We claim:

1. A bag, which comprises a product compartment defined by walls having at least two plies of film:

(a) a nonporous exterior film ply, and (b) a porous interior film ply as a bag liner for engagement with a package product, said porous interior film ply having inner and outer surfaces, said outer surface being in proximity to said nonporous exterior film ply, said porous interior film ply and nonporous exterior film ply being spaced sufficiently from one another to form an enclosed vacant fluid reservoir, said porous interior film ply having a plurality of tapered apertures extending from said outer surface of said interior film ply and emptying into said vacant fluid reservoir.

2. The bag of claim 1 wherein the tapered apertures of said porous interior film ply narrow in the direction of the nonporous exterior film ply.

3. The bag of claim 1 wherein the tapered apertures of said porous interior film ply are in the form of protuberances narrowing in the direction of the nonporous exterior film ply.

4. The bag of claim 3 wherein said protuberances of said porous interior film ply have a general conical configuration.

5. The bag of claim 1 wherein the apertures of said porous interior film ply are in the form of a plurality of regularly spaced protuberances of a configuration which readily permit the transmission of steam, vapor and fluids from the product compartment to the enclosed fluid reservoir while restricting the back flow of liquids from said reservoir to said product compartment.

6. The bag of claim 5 wherein the porous interior film ply is characterized by an open area from about 12 to about 20 percent, a mesh size in a range from about 18 to about 24 apertures/lineal inch and an average embossed film thickness from about 20 to about 25 mils.

7. The bag of claim 5 wherein the porous interior film ply is characterized by an open area from about 14 to about 18 percent, a mesh size in a range from about 20 to about 22 apertures/lineal inch, an average embossed film thickness from about 21 to about 24 mils, and comprises a blend of polyolefins

8. The bag of claim 1 comprising dual opposing side walls affixed to one another along peripheral edges.

9. The bag of claim 8 including an expandable bottom wall.

10. The bag of claim 9 including expandable side walls.

11. The bag of claim 1 comprising opposing quadrilateral side walls and a bottom wall.

12. The bag of claim 11 having expandable side walls.

13. The bag of claim 1 for packaging a cooked foodstuff selected from the group consisting of chicken, seafood, potatoes, onions, egg rolls, hush puppies, calzones and pizza.

14. The bag of claim 3 for packaging a cooked foodstuff selected from the group consisting of chicken, seafood, potatoes, onions, egg rolls, hush puppies, calzones and pizza.

15. The bag of claim 5 for packaging a cooked foodstuff selected from the group consisting of chicken, seafood, potatoes, onions, egg rolls, hush puppies, calzones and pizza.

16. A bag for maintaining the crispness of hot cooked foods, which comprises flexible walls conformed into the shape of a food compartment, said walls comprising a nonlaminated multi-ply film composite comprising:

(a) a nonporous exterior film ply, and (b) a porous nonabsorbent bag liner ply having an inner surface for engaging with cooked foods in said food compartment and an outer surface spaced from said nonporous exterior film ply to form an enclosed vacant fluid reservoir between said nonporous exterior film ply and porous nonabsorbent bag liner ply, said porous non-absorbent bag liner ply having a plurality of regularly spaced apertures for communication of said food compartment with said fluid reservoir, said apertures being of a configuration as to readily allow transmission of steam and oily liquids from said food compartment to said fluid reservoir while minimizing the back flow of oily liquids and condensate from said reservoir to said food compartment.

17. The crispness bag of claim 16 wherein said apertures of said porous nonabsorbent bag liner ply are in the form of tapered protuberances narrowing in the direction of said nonporous exterior film ply.

18. The crispness bag of claim 16 wherein said apertures of said porous nonabsorbent bag liner ply have a general conical configuration narrowing in the direction of said nonporous exterior film ply.

19. The crispness bag of claim 17 wherein said porous non-absorbent bag liner ply is characterized by an open area of about 12 to about 20 percent, a mesh size in a range from about 18 to about 24 apertures/lineal inch, an average embossed film thickness ranging from about 20 to about 25 mils, and comprises a blend of polyolefins.

20. The crispness bag of claim 16 comprising dual opposing side walls affixed to one another along peripheral edges.

21. The crispness bag of claim 20 including an expandable bottom wall.

22. The crispness bag of claim 21 including expandable side walls.

23. The crispness bag of claim 16 comprising opposing quadrilateral side walls.

24. The bag of claim 23 comprising expandable side walls.

25. The bag of claim 16 for packaging a cooked foodstuff selected from the group consisting of chicken, seafood, potatoes, onions, egg rolls, hush puppies, calzones and pizza.

26. The bag of claim 18 for packaging a cooked foodstuff selected from the group consisting of chicken, seafood, potatoes, onions, egg rolls, hush puppies, calzones and pizza.

27. The bag of claim 19 for packaging a cooked foodstuff selected from the group consisting of chicken, seafood, potatoes, onions, egg rolls, hush puppies, calzones and pizza.

28. A bag for maintaining the crispness of hot foods cooked in oil/fat, which comprises flexible walls conformed into the shape of a food compartment, said walls comprising a nonlaminated multi-ply film composite comprising:

(a) a nonporous exterior film ply, and (b) a porous nonabsorbent bag liner ply having an inner surface for engaging with cooked foods in said food compartment and an outer surface spaced from said nonporous exterior film ply to form an enclosed vacant fluid reservoir between said nonporous exterior film ply and porous nonabsorbent bag liner ply, said porous nonabsorbent bag liner ply having a plurality of apertures which readily permit the transmission of residual oil and steam from the food to the fluid reservoir while limiting the back flow of collected cooled oil and condensation from the reservoir to the food compartment.

29. The bag of claim 28 of suitable dimensions for packaging a fried foodstuff selected from the groups consisting of chicken, fish, seafood and potatoes.

* * * * *

Disclaimer 5,346,312 - Ronald D. Mabry, Orchard Park, N.Y.; Gerald F. Unger, Richmond Hts., Ohio. BAGS FOR MAINTAINING CRISPNESS OF COOKED FOODSTUFF. Patent dated Sept. 13, 1994. Disclaimer filed May 3, 1999, by the assignee, Flexo Transparent Inc., and The Unger Company.

Hereby enters this disclaimer to claims 1-29 of said patent.

*(Official Gazette,* July 27, 1999)